United States Patent [19]

Stuhmer

[11] 4,426,814

[45] Jan. 24, 1984

[54] PREFABRICATED GAZEBO

[76] Inventor: Adolf Stuhmer, 4680 Nambe Way,, Murray, Utah 84107

[21] Appl. No.: 315,352

[22] Filed: Oct. 26, 1981

[51] Int. Cl.[3] ..... E04B 7/06; E04B 7/10

[52] U.S. Cl. ..... 52/82; 52/376; 52/827; 52/830

[58] Field of Search ..... 52/82, 236.1, 264, 81, 52/283, 376, 85, 581, 827, 830

[56] References Cited

U.S. PATENT DOCUMENTS

| | | | |
|---|---|---|---|
| 739,646 | 9/1903 | Carter | 52/587 |
| 1,008,343 | 11/1911 | King | 52/376 |
| 1,711,163 | 4/1929 | Zabriskie | 52/376 |
| 2,358,388 | 9/1944 | Everitt | 52/82 |
| 2,775,794 | 1/1967 | Keely | 52/82 |
| 3,295,265 | 1/1967 | Naota Hida | 52/82 |
| 3,333,376 | 8/1967 | Marsters | 52/82 |
| 3,812,632 | 5/1974 | Robertson et al. | 52/81 |
| 4,173,855 | 11/1979 | Raptoplous | 52/82 |

FOREIGN PATENT DOCUMENTS

| | | | |
|---|---|---|---|
| 2138907 | 2/1972 | Fed. Rep. of Germany | 52/82 |

*Primary Examiner*—Alfred C. Perham

*Attorney, Agent, or Firm*—Philip A. Mallinckrodt; Robert R. Mallinckrodt

[57] ABSTRACT

A prefabricated gazebo having a floor assembly formed from a plurality of lengths of a structural supporting material secured together in polygonal formation and provided with joist members and joist support members secured to the polygon formation to support a deck material. A wall assembly is formed from a plurality of wall sections, each of which may be constructed in an arch formation, one such section being secured to each of the plurality of lengths of structural supporting material. Each wall section is also secured to the two adjacent wall sections. One wall section is adapted to serve as an entrance to the gazebo. A roof assembly is formed from a plurality of identical roof sections, one such section being secured to the center of the arch of each wall section, and also secured to the two adjacent roof sections. Each roof section includes a frame system having a central tube secured to the center of a partially circular plate, and a pair of radial frame members also secured to the partially circular plate, one extending outward from the plate on each side of the central tube. A pair of support members secure the central tube and radial frame members, respectively. A roof member is secured to each frame system and is covered by conventional weather protective materials.

10 Claims, 15 Drawing Figures

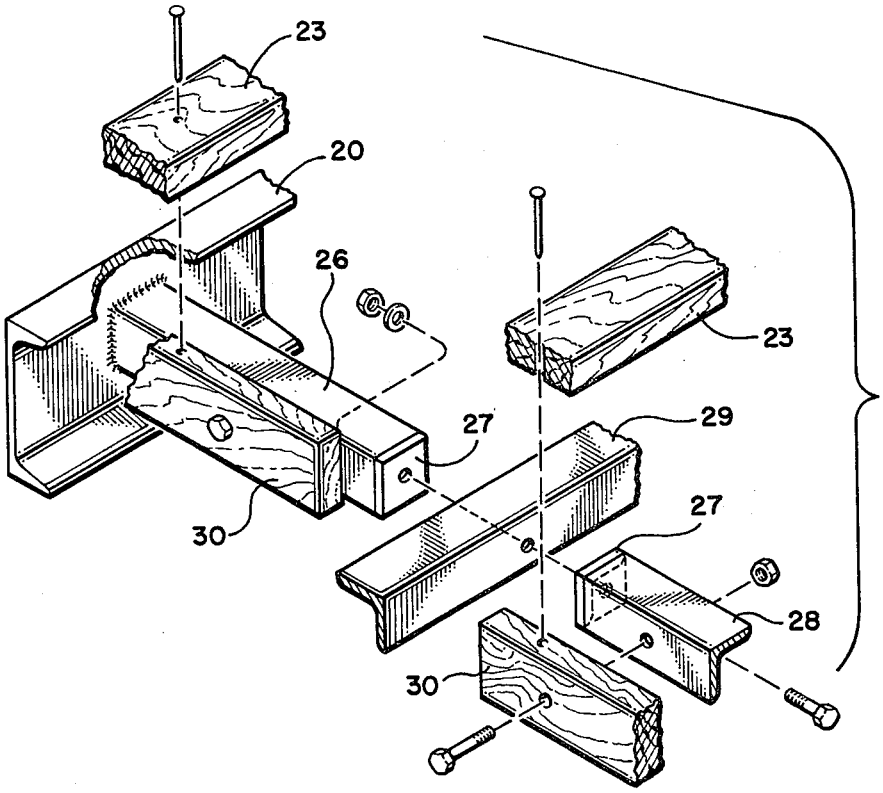
FIG. 10
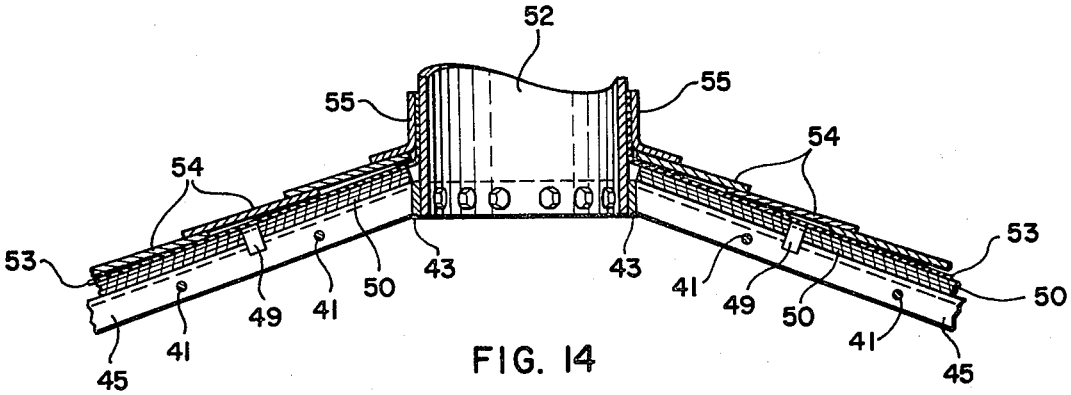
FIG. 14
FIG. 15
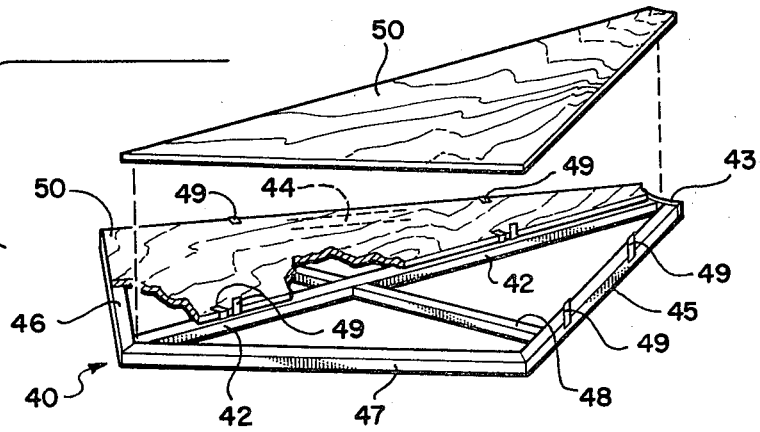

PREFABRICATED GAZEBO

BACKGROUND OF THE INVENTION

1. Field

The invention is in the field of prefabricated building structures, and is particularly concerned with prefabricated gazebos.

2. State of the Art

Gazebos have long been used as an ornamental as well as useful addition to garden areas. In times past, people have often constructed a gazebo in their garden. However, building a structure such as a gazebo is a time-consuming job requiring a great amount of skill, and thus, most people would not undertake to build one.

Therefore, for those persons who lack either the skill or the inclination to construct a gazebo from standard building materials, it is desirable to provide prefabricated components which can be readily assembled into an attractive and sturdy structure.

SUMMARY OF THE INVENTION

According to the present invention, a prefabricated gazebo is constructed in a novel manner. The gazebo is comprised of three major assemblies: a floor assembly, a wall assembly, and a roof assembly.

The floor assembly is formed from a plurality of lengths of a structual supporting material, such as channel iron, which are secured together to form a polygon. Joist members and joist support members are secured to the polygon structure to serve as a support for a deck material. Optionally, the floor assembly can be adapted for use with a hot tub.

The wall assembly is formed from a plurality of wall sections, one of which is secured to each of the plurality of lengths of structural supporting material. One of the wall sections is adapted to serve as an entrance to the gazebo. Each wall section is secured to the two adjacent wall sections to provide rigidity and structural integrity. Each wall section is constructed in an arch configuration.

The roof assembly is formed from a plurality of identical roof sections, one such section being provided for each wall section. The roof sections include a frame system having a central tube secured to the center of a partially circular plate, and a pair of radial frame members also secured to the partially circular plate, one extending outwardly from the plate on each side of the central tube. A pair of members secure the central tube and radial frame members, respectively. The frame system serves as a support for a roof member. The roof sections are secured to the center of the arch of the respective wall section, and also to the adjacent roof sections. The roof assembly may then be protected by tar paper and shingles in the conventional manner.

THE DRAWINGS

In the accompanying drawings, which represent the best mode presently contemplated for carrying out the invention:

FIG. 1 is a perspective view of the gazebo;

FIG. 2, a horizontal section taken along the line 2—2 of FIG. 1 with portions being broken away for convenience of illustration;

FIG. 3, a horizontal section taken along the line 3—3 of FIG. 1 showing the underside of the roof structure of the gazebo;

FIG. 4, an enlarged, fragmentary, exploded view of the portion of the gazebo enclosed by the line 4 of FIG. 2;

FIG. 5, a vertical section taken along the line 5—5 of FIG. 2;

FIG. 6, an enlarged fragmentary, view of the portion of the gazebo enclosed by the line 6 of FIG. 2;

FIG. 7, a vertical section taken along the line 7—7 of FIG. 6;

FIG. 8, a vertical section taken along the line 8—8 of FIG. 2;

FIG. 9, a fragmentary, horizontal section taken along the line 9—9 of FIG. 1;

FIG. 10, an enlarged, fragmentary, exploded view of a portion of the floor structure of the gazebo enclosed by line 10 of FIG. 2;

FIG. 11, a fragmentary, vertical section showing attachment of two roof sections to a wall section of the gazebo corresponding to the line 11—11 of FIG. 3;

FIG. 12, a fragmentary, horizontal section of the center portion of a roof section of the gazebo taken along the line 12—12 of FIG. 3;

FIG. 13, a fragmentary, vertical section of a roof section of the gazebo taken along the line 13—13 of FIG. 3;

FIG. 14, a fragmentary, vertical section of the roof assembly taken along the line 14—14 of FIG. 3; and FIG. 15, an exploded view of one of the six roof sections of the gazebo.

DETAILED DESCRIPTION OF THE ILLUSTRATED EMBODIMENT

Figure 9:
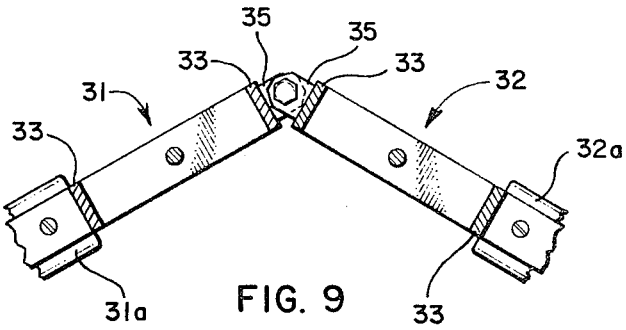

The present invention is a novel prefabricated gazebo. For purposes of discussion, it is convenient to consider the gazebo as consisting of three separate assemblies: a floor assembly, see FIGS. 2, 4, 5, 6, 7, 8, and 10; a wall assembly, see FIGS. 1 and 9; and a roof assembly, see FIGS. 3, 11, 12, 13, 14 and 15.

Beginning with the floor assembly, six equal lengths of channel recess iron 20 are cut at each end so as to fit together in hexagonal formation with the channel facing inward. Metal attachment plates 21 are provided at each end of each channel iron 20, and are positioned whereby each such plate can be bolted to the corresponding attachment plate 21 of the neighboring channel iron 20, see FIG. 6.

Figure 7:
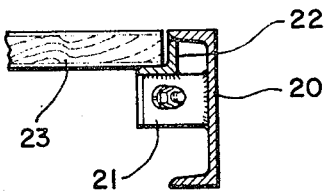

Deck supports 22 are formed from lengths of angle iron secured to four of the channel iron pieces 20 and the respective plates 21, with the angle pointing upward and inward as shown in FIG. 7 so as to receive the ends of deck boards 23. No deck support angle iron is needed for the channel iron **20*a*, FIG. 1, serving as the "front" of the gazebo nor for the "rear" channel iron 20*b* when the deck boards 23 are run parallel to the front and rear channel iron pieces as illustrated in FIG. 2**.

Other supports for deck boards 23 are formed by use of angle irons serving as joists and cross-members. Two relatively short joists 24 are formed of angle iron with the ends bolted at approximately the center of neighboring deck support angle irons 22, as indicated in FIG. 2.

Two longer joist assemblies 25 are secured between the front and rear channel iron pieces **20*a* and 20*b*. These joist assemblies are formed by welding two short lengths of angle iron 26 to both the front and rear lengths of channel iron 20*a* and 20*b*. An end cap 27 is welded to the end of each such short length of angle iron 26, and another end cap 27 is welded to each end of two span joist angle iron pieces 28 which run between the short lengths of angle iron 26. Two cross-members 29 are secured to deck supports 22 as indicated in FIG. 2, and are bolted to respective end caps 27 of angle iron pieces 26 and span joists 28 in the manner shown in FIG. 10**.

The angle irons used in forming joists 24, cross-members 29, span joists 28, and short pieces 26 all preferably have the angle recess facing downward so that the upper surface be may be used to support deck boards 23.

Figure 8:
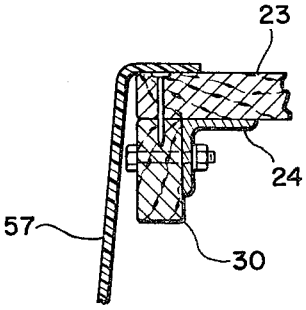
Figure 4:
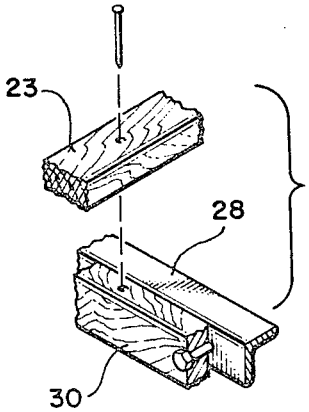
Figure 6:
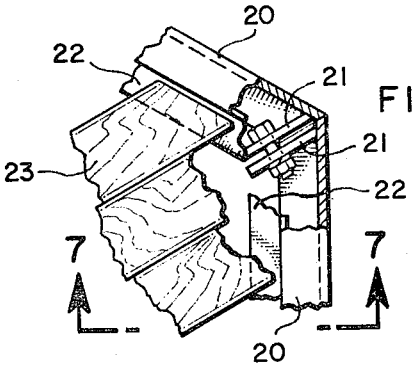
Figure 5:
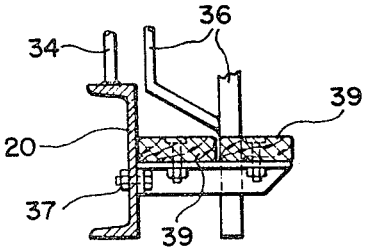

Nail-receiving boards 30 are bolted to the vertical side of each joist angle iron in the manner shown in FIGS. 4, 8, and 10. Deck boards 23 are then secured in place by nailing them to nail-receiving boards 30.

To insure that the deck boards have an even surface to rest upon, the nail-receiving boards 30 should be bolted to the joist members 24, 26, and 28 at positions whereby the upper surfaces of the nail-receiving boards are flush with, or higher than, the upper surfaces of cross-members 29. In the latter case, deck boards 23 will rest solely upon nail-receiving boards 30.

It can be seen that each individual deck board 23 must be cut to a particular length and the ends of some boards must be cut at an angle. Accordingly, when preparing a prefabricated gazebo it is preferred that each board 23 be labeled in some manner so as to indicate its proper position. During construction, it is contemplated that the longest board **23*a*** will be secured in place first, and then the remaining boards, working from the center towards the front and rear, respectively.

Figure 1:
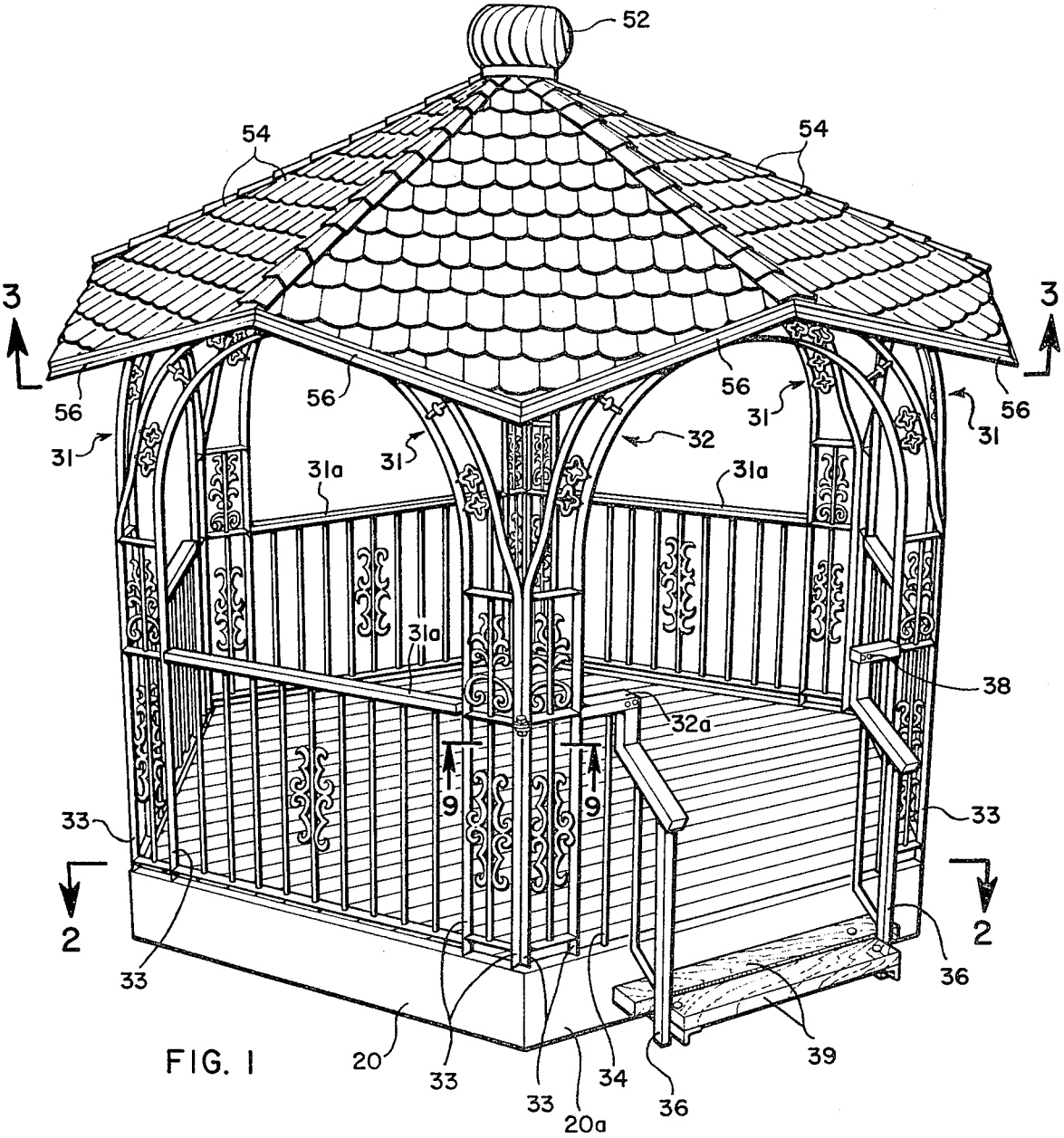
Figure 2:
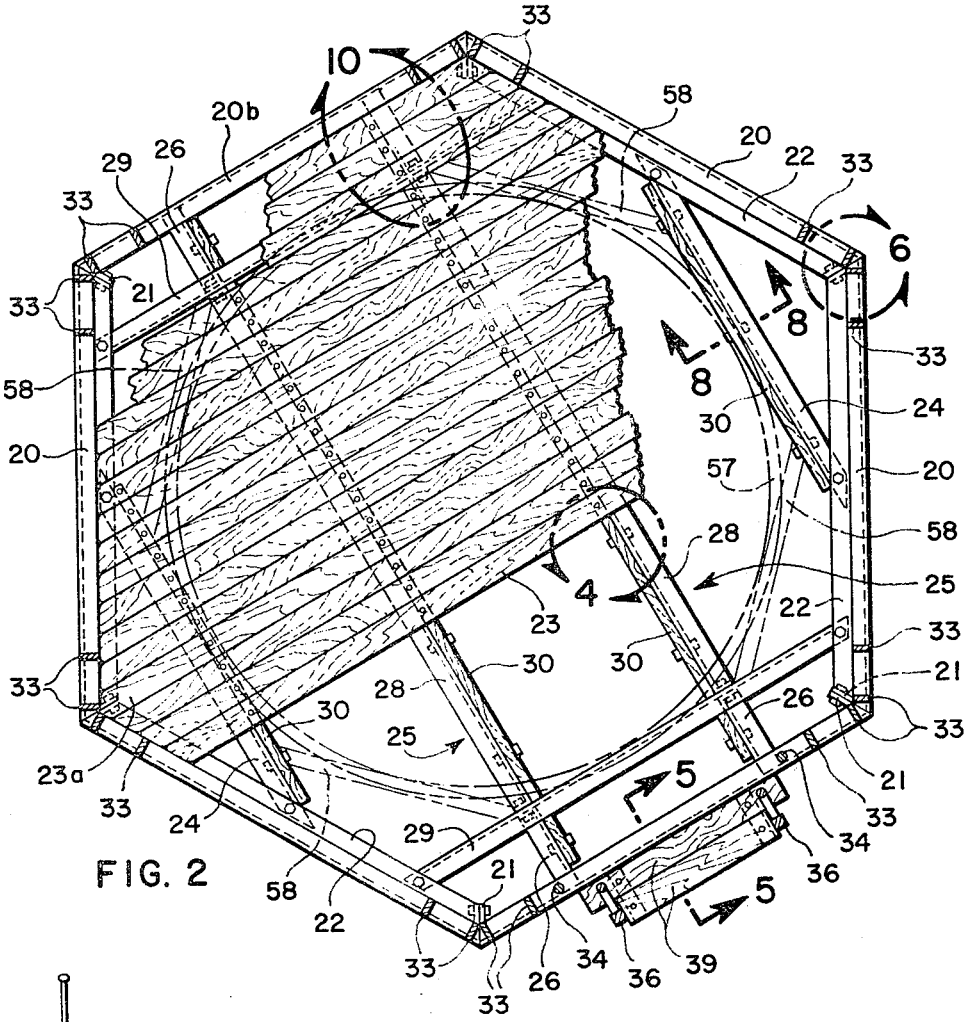

The wall assembly of the illustrated embodiment consists of five wall sections 31 and one entrance section 32, each of arch formation, preferably a current arch as illustrated in FIG. 1 the entrance section being secured to front channel iron **20*a*. Although it is convenient for purposes of discussion herein to consider the wall assembly as a separate assembly, it is contemplated that the vertical posts 33 of each wall section 31 and of entrance section 32 will be welded in place at the manufacturing plant to the respective channel iron. In addition, entrance section 32 is provided with rods 34 which are welded to the channel iron 20*a*. Each wall section 31 and entrance section 32 is bolted to the two adjacent sections by means of tabs 35 in the manner shown in FIG. 9. Tabs 35 are secured to the outside face of verticals 33 of the wall sections 31 and of entrance section 32**.

Two hand rails 36 are attached to the front channel iron section using bolts 37, and to each respective hand rail of entrance section 32 by means of bolts 38. Step boards 39 are then secured to the two hand rails 36. Handrails **31*a* and 32*a* are also mounted to wall sections 31 and entrance section 32**, respectively.

The roof assembly is formed from six substantially kite-shaped sections 40, see FIG. 15, bolted together by bolts 41. Each section has a frame system including a square tubular member 42 which is welded to the center of a partially circular metal plate 43. Angle iron pieces 44 and 45 are also welded to plate 43 and extend radially outward therefrom, one on each side of the central tubular member 42. Support angle iron pieces 46 and 47 are welded between the other end of tubular member 42 and radial angle irons pieces 44 and 45. A reinforcing member 48 is preferably welded between tubular member 42 and angle radial iron pieces 44 and 45 for additional strength.

Each angle iron piece 44, 45, 46, and 47 is arranged with the angle recess facing downward and towards tubular member 42. The angle iron pieces and tubular member 42 are provided with tabs 49. Two sheets of plywood 50, are positioned on top of tubular member 42, angle iron pieces 44, 45, 46, and 47, respectively, and members 48, and are secured in place by bending over the ends of tabs 49 as indicated in FIGS. 11–15.

Figure 3:
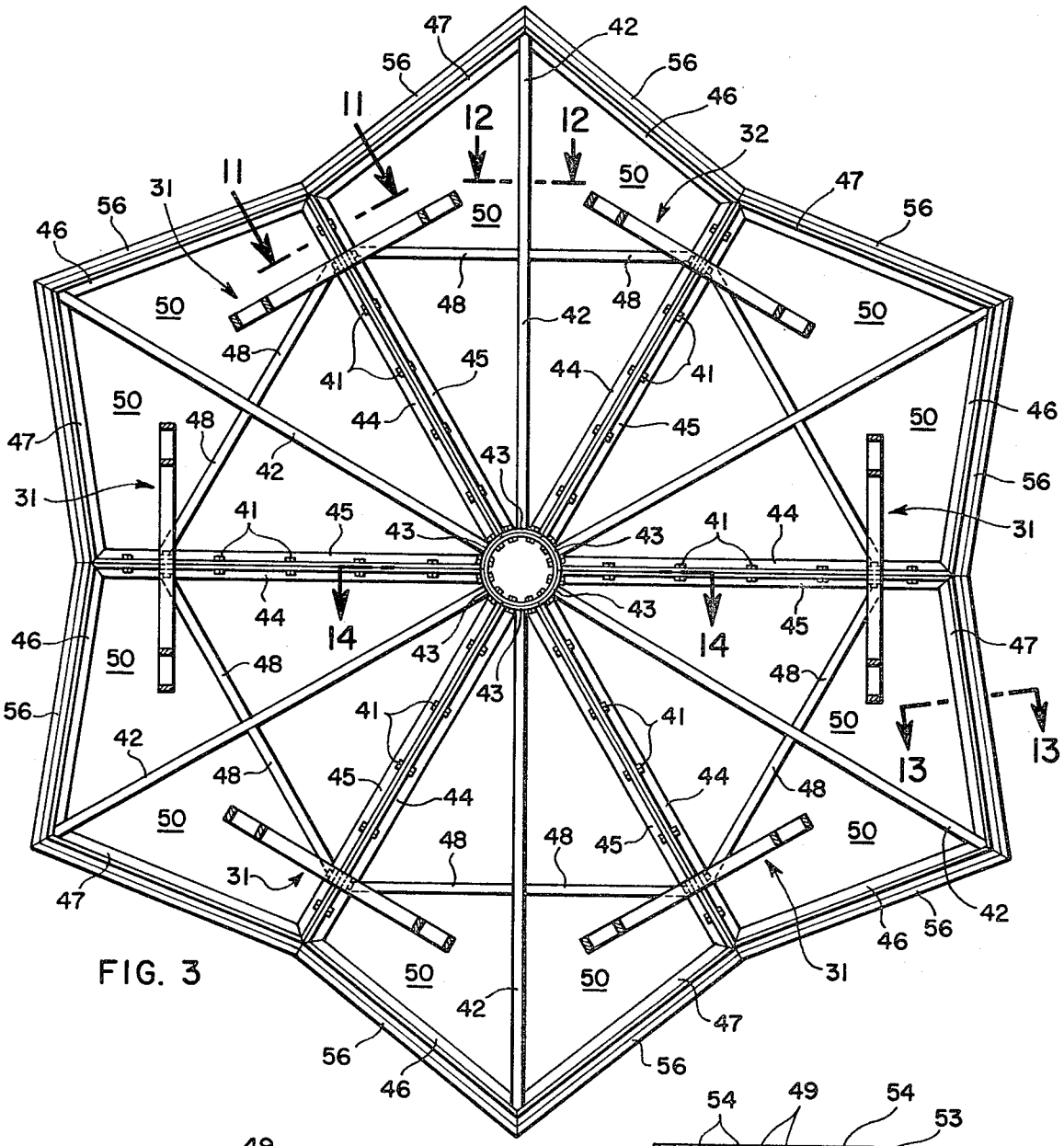
Figure 11:
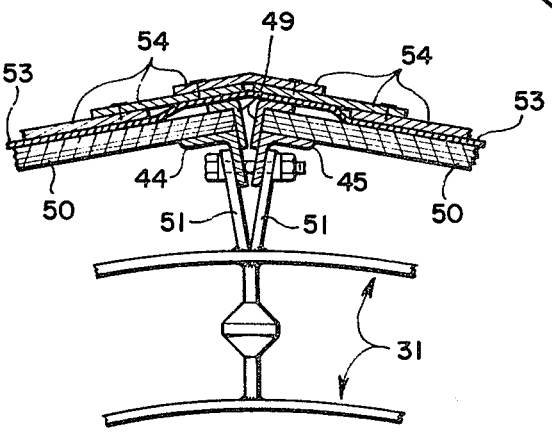
Figure 12:
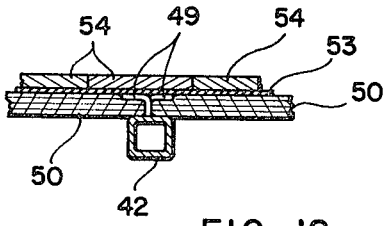

The six roof sections 40 are bolted together loosely with bolts 41, FIGS. 3 and 14, and the roof assembly is bolted to upstanding clips 51, which extend upwardly from the center of the arch of each wall section in the manner shown in FIG. 11. When the six roof sections are bolted together, the respective partially circular plates 43 fit together to form a complete circle.

It can be seen in FIG. 11 that the radial angle iron pieces 44 and 45 of adjacent roof sections 40 do not fit flush against one another, but rather are at an angle. This is the result of securing several flat roof sections together into a cone-shape. After all of the roof sections have been bolted to the respective clips 51 of wall sections 31 and entrance section 32, bolts 41 may be tightened.

Optionally, a wind turbine 52, or some decorative structure (not shown) may be secured to the interior of the circle formed by plates 43. Alternatively, a cover plate (not shown) may be attached to plates 43.

The roof can then be completed by applying roofing in conventional manner. Thus, a layer of tar paper 53 is advantageously placed upon the top of the roof structure, and shingles 54 are nailed in place over the tar paper.

Figure 13:
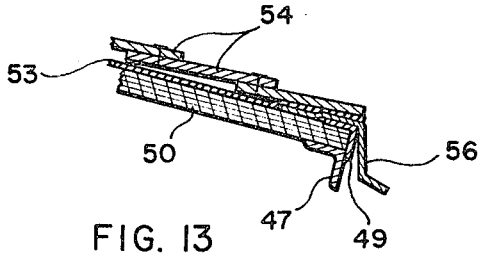

A flashing 55 may be secured around turbine 52, and another flashing 56 may be secured on the edge of each roof section as shown in FIG. 13.

The gazebo structure may be altered slightly in order to provide support and cover for a hot tub 57, the position of which is indicated in phantom in FIG. 2. In order to support the hot tub and also deck boards 23, four additional lengths of angle iron 58 may be added between joists 24 and joist assemblies 25, as indicated in phantom in FIG. 2. The deck boards 23 would preferably be cut so as to terminate under the lip of hot tub 57 as shown in FIG. 8. A hole (not shown) would be required in the ground to receive most of the depth of the hot tub and to provide support for the weight of the hot tub. Only a few inches of the hot tub coresponding to the height of channel iron 20 would be above ground level.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A prefabricated gazebo, comprising a floor assembly including a plurality of lengths of support material secured together in polygonal formation, deck support means secured to said polygonal formation, and deck means secured to said deck support means; a wall assembly including wall sections, each having an arch formation and being secured to a length of said support material, one of said wall sections serving as an entrance to the gazebo, each of said wall sections being secured to adjacent wall sections; and a roof assembly including a plurality of roof sections secured one to another and each to a wall section, each of said roof sections having a frame including a longitudinal central member having one end secured to the center of a partially circular plate, a pair of radial frame members extending outwardly from said partially circular plate, one on each side of said central member, and a pair of support frame members securing said radial frame members to said central member, and roofing means secured to the frames of said roof sections.

2. A prefabricated gazebo according to claim 1, wherein the plurality of lengths of support material are lengths of channel iron arranged with the channel facing inwardly.

3. A prefabricated gazebo according to claim 2, wherein each length of channel iron is provided with attachment plates at opposite ends thereof, respectively, and secured to the corresponding attachment plates of the adjacent lengths of channel iron, thus securing said lengths of channel iron in polygonal formation.

4. A prefabricated gazebo according to claim 3, wherein the polygonal formation is a hexagon.

5. A prefabricated gazebo according to claim 1, wherein the deck support means comprises a plurality of joists formed from lengths of angle iron to which nail-receiving boards are secured.

6. A prefabricated gazebo according to claim 1, wherein each wall section is attached to the adjacent wall sections by means of attachment plates provided on opposite ends, respectively, of each of said wall sections and by bolts passing therethrough.

7. A prefabricated gazebo according to claim 1, wherein the roof means comprises a pair of substantially triangularly shaped members for each frame secured, respectively, at opposite sides of the central member and to the respective radial frame members and support frame members.

8. A prefabricated gazebo according to claim 7, wherein the substantially triangularly-shaped members are secured to the central members by means of metal clips which extend upwardly therefrom and from the radial frame members and from the support frame members, said metal clips being bent over said triangularly-shaped members.

9. A prefabricated gazebo according to claim 1, wherein each roof section is secured to the center of the arch of a wall section.

10. A prefabricated gazebo according to claim 9, wherein each wall section arch is of curved formation.

* * * * *